US005549066A

United States Patent [19]

Kingsbury

[11] Patent Number: 5,549,066

[45] Date of Patent: Aug. 27, 1996

[54] TRIANGULAR BOAT HULL APPARATUS

[76] Inventor: Robert P. Kingsbury, 377 Union Ave., Laconia, N.H. 03246

[21] Appl. No.: 509,814

[22] Filed: Aug. 1, 1995

[51] Int. Cl.[6] ..... B63B 1/00

[52] U.S. Cl. ..... 114/56; 114/61

[58] Field of Search ..... 114/56, 61, 355

[56] References Cited

U.S. PATENT DOCUMENTS 364,638 6/1887 Forward ..... 114/56

394,416 12/1888 Tucker ..... 114/56

*Primary Examiner*—Jesus D. Sotelo

*Attorney, Agent, or Firm*—William B. Ritchie

[57] ABSTRACT

A multi-hull design constructed from flat pieces of material instead of curved sections normally used for boat hull construction. The design is economical to build since it makes the best use of modern construction materials. Application to all types and sizes of boats is possible. Likewise, efficient use of all kinds of propulsion can be accommodated. The use of triangular cross sections and triangular fore and aft wave penetrating sections provide an enormously strong hull. The dual fore and aft wave penetrating sections increase sea keeping ability in very severe sea conditions. Machinery and stores can be loaded below centerline of the air and water tight hull to give a self-righting movement to the design, making it inherently safe if rolled-over or capsized.

9 Claims, 17 Drawing Sheets

TRIANGULAR BOAT HULL APPARATUS

BACKGROUND OF THE INVENTION

1. Field of the Invention

The invention relates to boat hull designs.

2. Description of the Related Art

It is well known in the industry that watercraft with a multi-hull design provide better seakeeping in moderate-to-high wave conditions than monohull vessels. Multi-hull ships can be designed to suffer only one-half to one-fifth of the heave, pitch, and roll motions of a monohull vessel of equal displacement in seas driven by wind speeds above 20 knots.

An additional benefit of multi-hull designs is they can travel at faster speeds than a monohull design. The wave penetrating features of a multi-hull design allow the watercraft to also maintain course and speed during sea conditions that would otherwise defeat a monohull's ability to maintain the same course and speed.

However, an inherent problem with multi-hull designs is, in the event of a roll-over, they do not return upright once capsized. A multi-hull vessel is equally stable capsized as it is upright. Monohull vessels do not have this problem.

Through innovative designs and concepts, various hull designs have been introduced. In an article titled "Variable Draft Broadens SWATH Horizons" in the April 1994 issue of Proceedings, improvements are made to the design known as Small Waterplane Area Twin-Hull (SWATH) ships. The SWATH design for this particular boat utilizes struts that are aligned on the centerline of the lower hull. The lower hull's rectangular cross sections enhance seakeeping at deeper drafts and give best propulsion at transit depths. The center bow provides a cushion against slamming and affords convenient overboard access for handling equipment. Rectangular hull forms supportive of the SWATH design are less expensive to fabricate and outfit than conventional hull designs.

The U.S. Navy test vessel, Sea Shadow, was built to test several aspects of maintaining stealthiness at sea, including low radar visibility, quietness to sonar sensors and minimizing wake. An article titled "The Secret Ship" in the October 1993 issue of *Popular Science* discussed the unclassified parameters of this vessel. Above the waterline, the Sea Shadow's resemblance is similar to that of the U.S. Air Force F-117A stealth fighter. From the waterline down, the exact details are classified, but the ship's underwater shape is essentially a SWATH design. A pair of submerged pontoons gives the Sea Shadow its buoyancy. Running beneath the water's choppy surface layer, these pontoons cause far less of the seasickness-inspiring vertical motion inherent in traditional monohull designs.

Another unique design is the trimaran hydrofoil designed and built by Greg Ketterman, as discussed in an article titled, "World's Fastest Sailboat," in the January 1991 issue of *Popular Science*. The hydrofoil is a two-mast, triple-hull design that utilizes sensors forward of the outer hulls that hug the water's undulating surface, constantly adjusting the pitch of the hulls and main foils to maintain stability and minimize drag. Foot pedals control the rudder. This design is primarily for sail boats that want to maximize speed through the waters.

Prior art multi-hull designs share the disadvantage that they are not self-righting in the event of a roll-over or if capsized, which is not the case with monohull designs. Also, multi-hull designs are not entirely constructed out of flat plate material, which is a factor in cost and complexity to build. Thus, a multi-hull design that is self-righting and easily constructed is not disclosed in the prior art.

SUMMARY OF THE INVENTION

It is an object of the invention to provide a triangular boat hull apparatus that is constructed from flat pieces of material instead of curved sections normally used for boat hull construction.

It is another object of the invention to provide a triangular boat hull apparatus that is economical to build.

It is another object of the invention to provide a triangular boat hull apparatus that is bilaterally symmetrical and is fore and aft symmetrical.

It is another object of the invention to provide a triangular boat hull apparatus that minimizes waste during construction by utilizing symmetrical parts.

It is another object of the invention to provide a triangular boat hull apparatus that can be applicable to a variety of large and small watercraft.

It is another object of the invention to provide a triangular boat hull apparatus that utilizes a triangular shape design to improve hull strength in both compression and tension.

It is another object of the invention to provide a triangular boat hull apparatus that can be constructed from any of the materials typically used in the boat construction industry, including exotic materials.

It is another object of the invention to provide a triangular boat hull apparatus that has dual ended fore and aft wave penetrating features to provide added strength compared to other types of wave penetrating hull designs.

It is another object of the invention to provide a triangular boat hull apparatus that has dual ended fore and aft wave penetrating features in order to provide greater stability, particularly when the wave motion is severe.

It is another object of the invention to provide a triangular boat hull apparatus that is both air and water tight, in the event of a roll-over, no water would enter.

It is another object of the invention to provide a triangular boat hull apparatus that is self-righting by placing machinery and stores or water ballasts in the hull areas below the waterline.

It is another object of the invention to provide a triangular boat hull apparatus that is compatible with any means commonly used for propulsion.

It is another object of the invention to provide a triangular boat hull apparatus that allows a secondary cover to be installed parallel to the basic hull.

It is another object of the invention to provide a triangular boat hull apparatus that allows a hinged, moveable platform to be installed that could function as a landing deck for a helicopter, provided the triangular boat hull apparatus is of a size sufficient to handle the weight and dimensions of a helicopter.

It is a final object of the invention to provide a triangular boat hull apparatus that allows hydrodynamic efficient attachments to be affixed to the hull's flat surfaces to facilitate movement through the water.

The invention is a triangular boat hull apparatus which has forward and aft wave penetrating features. The hull is triangular shaped, as are the plurality of structural members which are positioned within the hull. A plurality of flat panels are affixed to the structural members to enclose the hull.

DETAILED DESCRIPTION OF THE INVENTION

Figure 1:
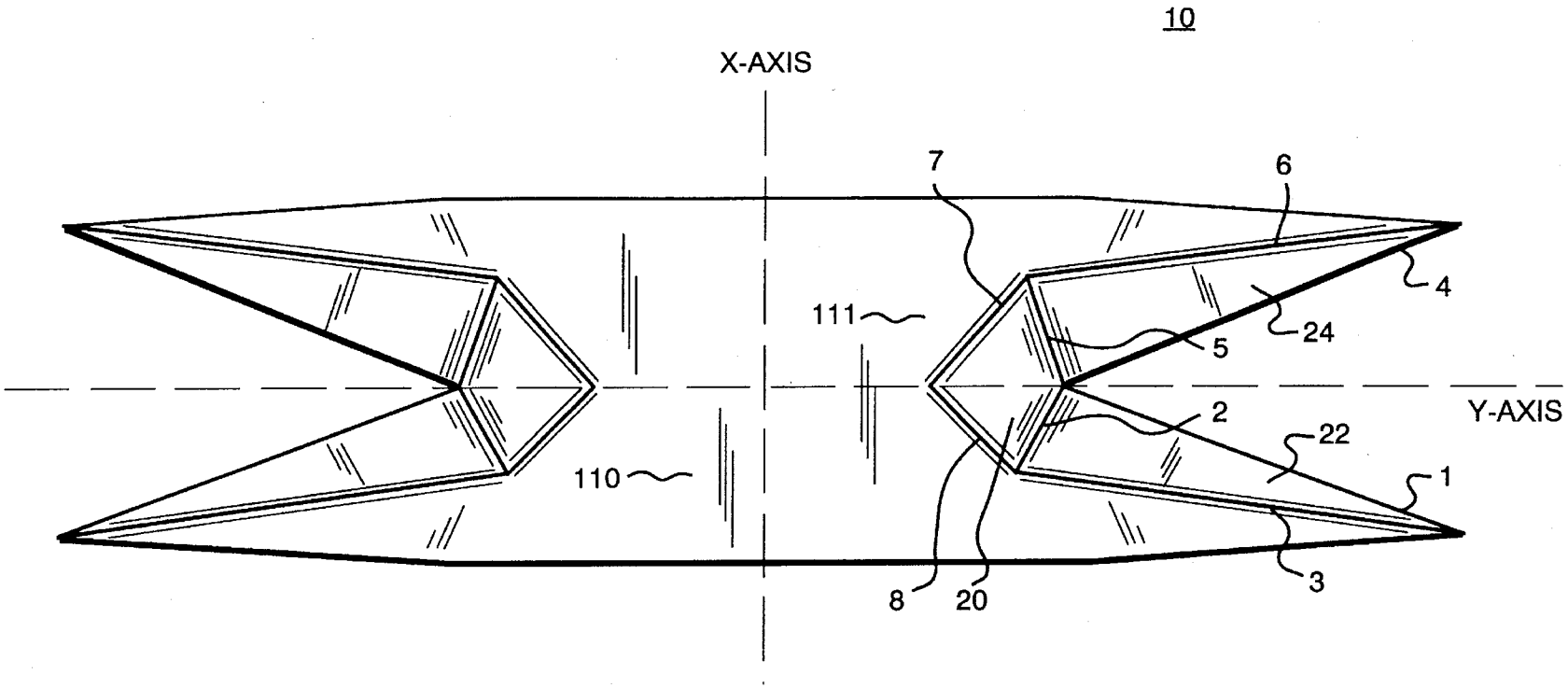
FIG. 1 is a top view of the triangular boat hull apparatus.

The invention is a bilateral fore and aft symmetrical boat hull that utilizes triangular shaped wave penetrating features for increased stability and safety. FIG. 1 is a top view of triangular boat hull apparatus 10. Apparatus 10 is constructed entirely from flat pieces of material instead of curved sections normally used for hull construction.

Apparatus 10 can be sized for a variety of watercraft. For example, a rowboat sized triangular boat could be built in a garage. Larger boats could be built in any boat yard large enough to handle the size boat desired to be built. Applications would be very broad, from Coast Guard cutters to fishing trawlers, yachts and pleasure boats. As a representative example, the details will be provided for a 26 foot sailboat. Building craft of other sizes will require scaling the dimensions accordingly using techniques well known in the art. The materials selected for construction are molded fiberglass. Other types of material typically used in the boat construction industry, including exotic materials, could be used.

The bilateral construction of apparatus 10 provides two 26 foot symmetrical halves when split down the y-axis, as illustrated in FIG. 1. Likewise, if one of the two symmetrical 26 foot long halves is then split down the x-axis, the resulting two 6.5 foot wide halves are also symmetrical. Because of the symmetrical aspects of this invention, only one-half of apparatus 10 needs to be discussed in detail to enable one skilled in the art to build the entire triangular boat hull apparatus 10. All one merely needs to do is to use the same dimensions and angles from the side that will be discussed in detail in the following paragraphs and transpose them to the other side.

The wave penetrating section of the hull will be discussed first. Flat panel 22 is a right triangle with dimensions of 7.6 feet for edge 1, 1.9 feet for edge 2, and 7.83 feet for edge 3. The angle formed by edges 1 and 2 is 90 degrees. The corresponding interior angles are 60 degrees at the corner of edges 2 and 3 and 30 degrees at the corner of edges 1 and 3. The triangular shapes used to provide the wave penetrating section improve the strength of hull apparatus 10 in both compression and tension so that heavy sea conditions will not buckle or pull apart hull apparatus 10. Flat panel 24 (mirror image of panel 22), which is part of the port side (assume the drawing is oriented with right side of the page facing forward) wave penetration section is also a right triangle which is symmetrical in all respects to flat panel 22. The dimensions are 7.6 feet for edge 4, 1.9 feet for edge 5, and 7.83 feet for edge 6. The angle formed by edges 4 and 5 is 90 degrees. The corresponding angles are 60 degrees at the corner of edges 5 and 6 and 30 degrees at the corner of edges 4 and 6.

The dimensions and angles provided for flat panels 22 and 24 can vary to correspond with other dimensions selected for the desired size of triangular boat hull apparatus 10 to be built.

Flat panel 20 is symmetrical about the y-axis. The dimensions are 1.9 feet along edges 2 and 5, and 2.54 feet along edges 7 and 8. The angle formed by edges 2 and 5 is 90 degrees. The corresponding interior angles are 105 degrees at the corner of edges 2 and 8, 60 degrees at the corner of edges 7 and 8, and 105 degrees at the corner of edges 5 and 7.

Figure 2:
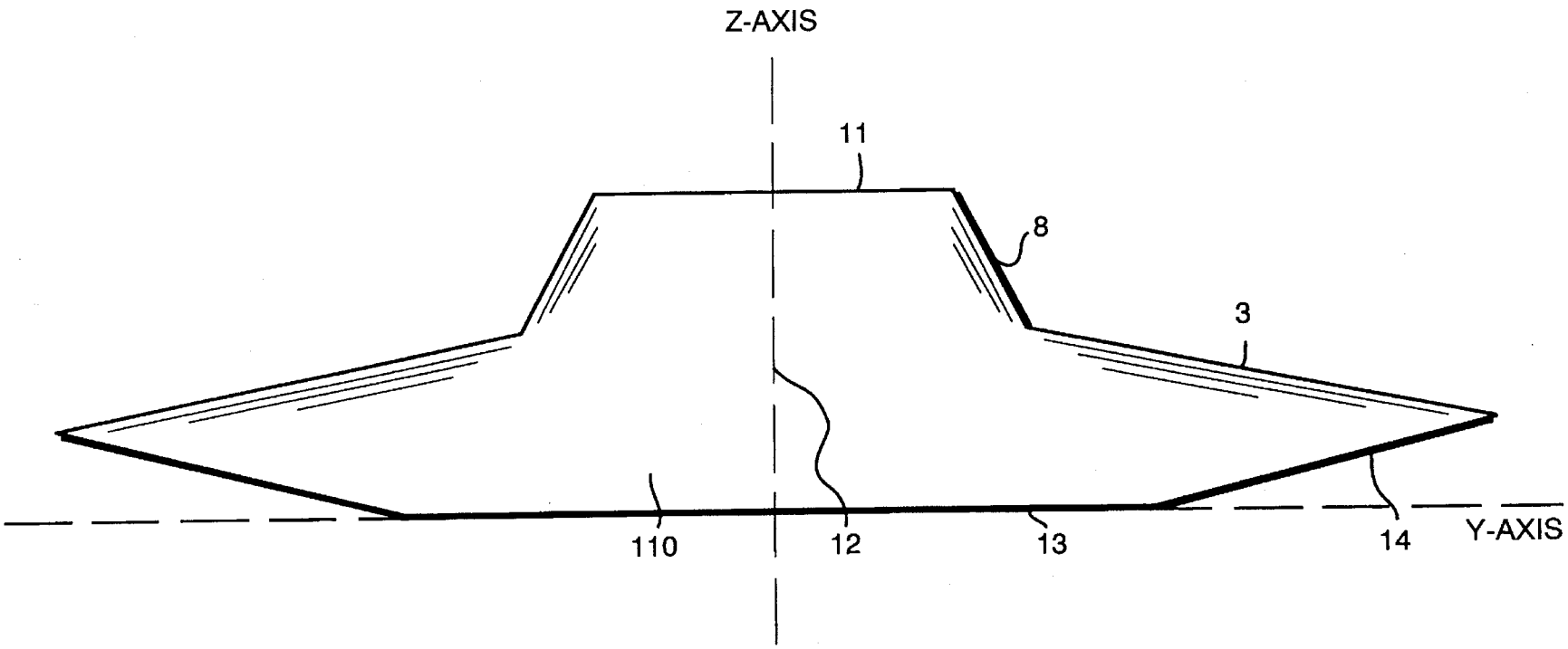
FIG. 2 is a side view of the triangular boat hull apparatus.

FIG. 2 is a side view of triangular boat hull apparatus 10. The following dimensions for side panel 110 correspond to those of a 26 foot sail boat. Dimensions are only provided for one half of the axis due to the symmetry of side panel 110. The dimensions about the perimeter of one-half of side panel 110 are 3.33 feet along edge 11, 6.5 feet along edge 12, 6.5 feet along edge 13, 6.6 feet along edge 14, 8.6 feet along edge 3, and 2.85 feet along edge 8. The angle formed by edges 11 and 12 and edges 12 and 13 are both 90 degrees. The remaining interior angles are 165 degrees at the corner of edges 13 and 14, 25 degrees at the corner of edges 3 and 14, 230 degrees at the corner of edges 3 and 8, and 120 degrees at the corner of edges 8 and 11. The other side of triangular boat hull apparatus 10, that is, panel 111, (shown in FIG. 1) has the same dimensions as side panel 110 due to the bilateral symmetry. Panel 22 joins panel 110 along edge 3 to form two parts of the three part wave penetration section.

Figure 3:
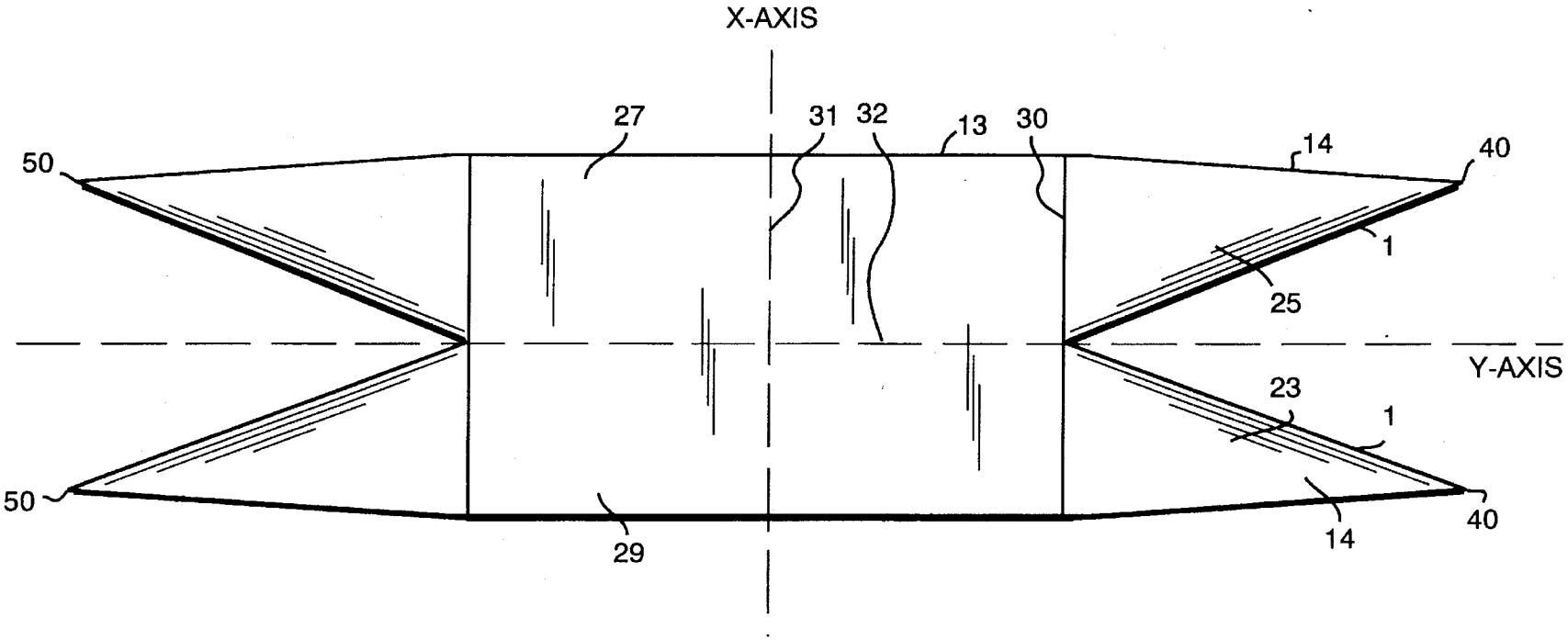
FIG. 3 is a bottom view of the triangular boat hull apparatus.

FIG. 3 is a bottom view of triangular boat hull apparatus 10. Dimensions are only provided for one half of the x- and y-axis due to the bilateral symmetry of the invention. Again, the following dimensions correspond to those of a 26 foot sail boat. Flat panel 25 is a right triangle with dimensions of 7.6 feet for edge 1, 6.6 feet for edge 14, and 3.8 feet for edge 30. The angle formed by edges 14 and 30 is 90 degrees. The corresponding angles are 60 degrees at the corner of edges 1 and 30 and 30 degrees at the corner of edges 1 and 14.

Flat panel 23 is also a right triangle with dimensions and angles identical to those of flat panel 25. The dimensions and angles provided for flat panels 23 and 25 can vary to correspond with other dimensions selected for the desired size of triangular boat hull apparatus 10 to be built. For instance, larger boats may require larger wave penetrating features, thus larger wave penetrating sections with respect to the size of the underside hull design. In other words, a larger boat hull may require panels 23 and 25 to be larger in perspective to panels 27 and 29 than currently shown for a 26 foot sail boat design. Likewise, other aspects of the boat hull would change. Panel 27 is joined with panel 22 and 110 to complete a wave penetrating section. Similarly, panel 29 is joined with panel 24 and panel 111 to complete the other bow penetrating section.

The center section comprises flat panels 27 and 29 which are joined together with the center section of panels 110, 111 to complete the triangular center section of the hull. Again, both panels are symmetrical about the x- and y-axis. From the dimensions provided for one-half of flat panel 27, the entire panel can be formed due to the bilateral symmetry of the design. Likewise, flat panel 29 is identical in measurements to panel 27 and can be cut to the same dimensions. The dimensions for one-half of panel 27 are 3.8 feet along edges 30 and 31, and 5.4 feet along edges 13 and 32. The interior angles formed are all 90 degrees due to the rectangular shape of panel 27.

The dual fore 40 and aft 50 hull sections are the wave penetrating features of the invention which provide added strength compared to other types of wave penetrating hull designs. Fore 40 and aft 50 hull sections give an easier motion in severe weather. This double ended design also adds greater stability, particularly when the wave motion is severe.

Figure 4:
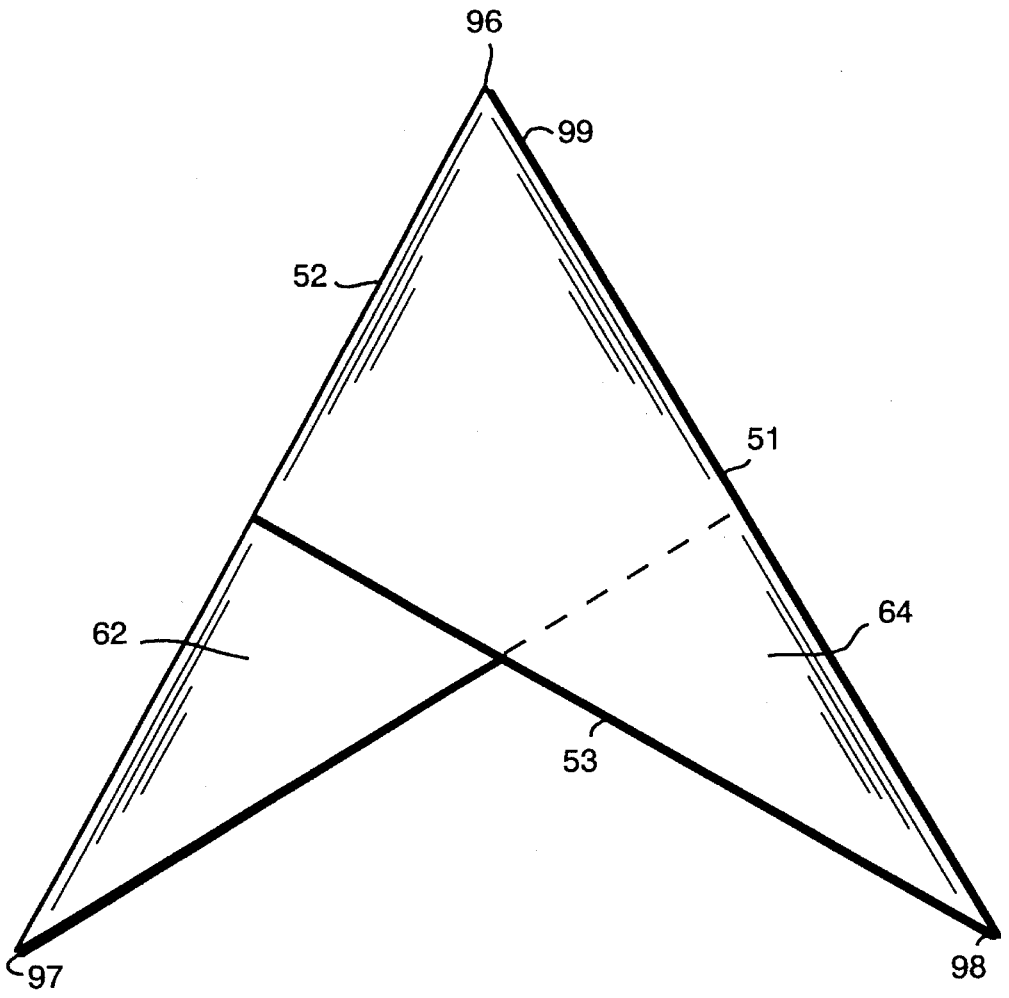
FIG. 4 is a cross-sectional view of a structural rib of the triangular boat hull apparatus.

FIG. 4 is a cross-sectional view of structural rib 99 that serves as an interior support of triangular boat hull apparatus 10. Structural rib 99 is made up of two right triangles. Triangle 64 is stacked on top of triangle 62 and secured together by screws or some other suitable form of attachment that is typical in the art. The order of stacking is not critical. What is critical is that the 30 degree angles must be at points 97 and 98 while the 60 degree angle is positioned at point 96.

Figure 4A:
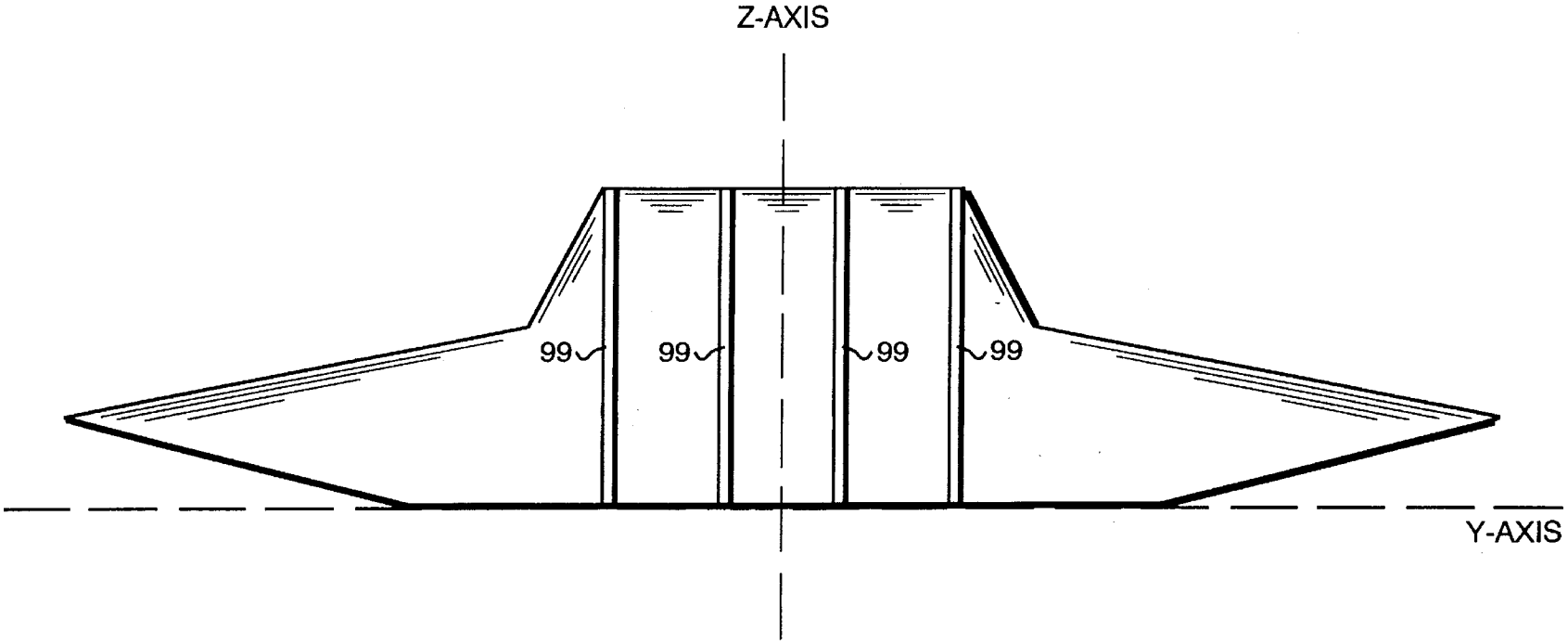
FIG. 4*a* is a side view of the triangular boat hull apparatus illustrating positioning of the structural ribs.

For a 26 foot by 6.5 foot sailboat as depicted in this description of operation, structural ribs 99 would be spaced every 2 feet within the main body of the invention. Thus, a total of 4 structural ribs 99 would be contained within the main body of the triangular boat hull apparatus 10. Reference FIG. 4*a* for a side view of triangular boat hull apparatus 10 for illustration of the positioning of structural ribs 99. The exact number will vary depending on the size and intended use of the boat. Attachment of the flat plate panels to structural ribs 99 is accomplished via screws. Alternative methods of securing the pieces together that are typical in the industry are also acceptable.

The dimensions of triangle 64 are 6.5 feet along edge 51, 3.3 feet along edge 52, and 5.7 feet along edge 53. The angle formed by edges 52 and 53 is 90 degrees. The other corresponding interior angles are 30 degrees at the corner of edges 51 and 53, and 60 degrees at the corner of edges 51 and 52. The measurements of triangle 62 are identical to those just described for triangle 64. This double triangle design improves the strength of hull apparatus 10 in both compression and tension so that heavy sea conditions will not buckle or pull apart hull apparatus 10.

Figure 5:
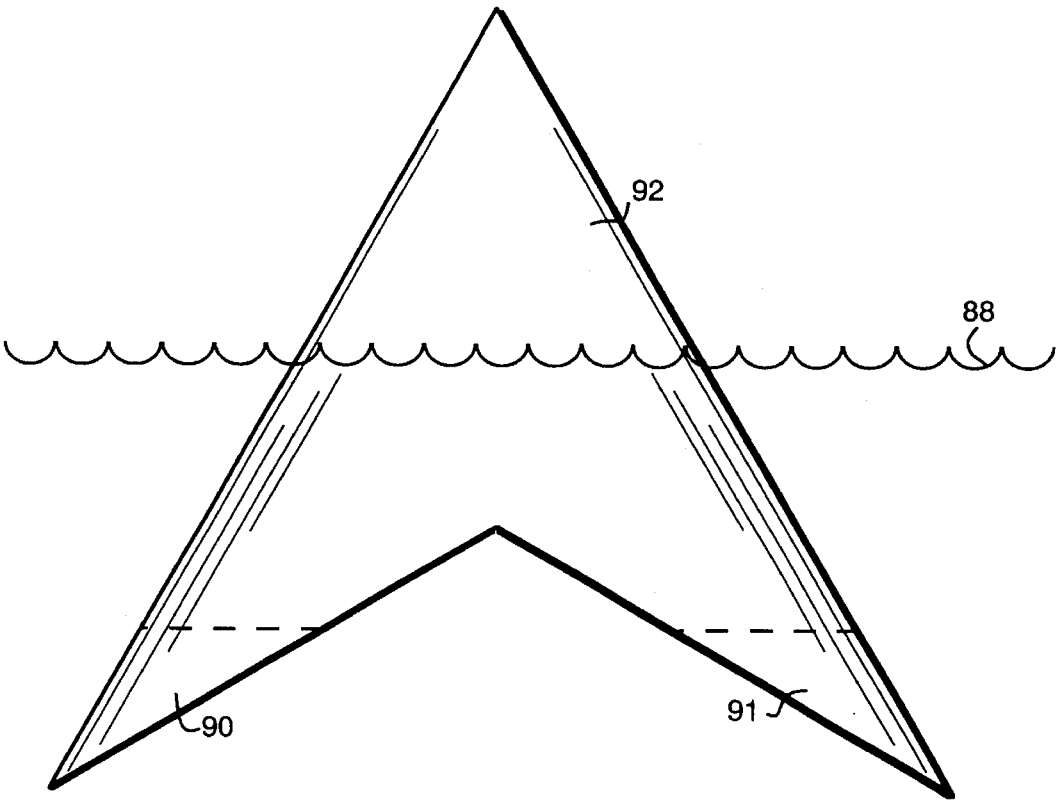
FIG. 5 is a cross-sectional view of the triangular boat hull apparatus representing a self-righting hull.

FIG. 5 is a cross-sectional view of the invention representing a self-righting hull. The entire hull is air and water tight, so in the event of a roll-over, no water 88 would enter. Hull apparatus 10 is made self-righting by placing machinery and stores (not shown) in areas 90 and 91, which is below the mid-point of each side. For a hull of the size depicted by this invention, it would be impractical to place stores and machinery in areas 90 and 91. Thus, ballast tanks could be added within areas 90 and 91 to assure a self-righting hull. Upper area 92 of hull apparatus 10 is essentially empty air space so that in the event of a roll-over or if capsized, area 92 would float higher than the more heavily laden hull areas 90 and 91, and thus would tend to provide the buoyancy needed to have the boat right itself in any sea state. Provisions (not shown) would be made so that the machinery and stores or ballast tanks are tied down and contained in place in the event of a roll-over.

Figure 6B:
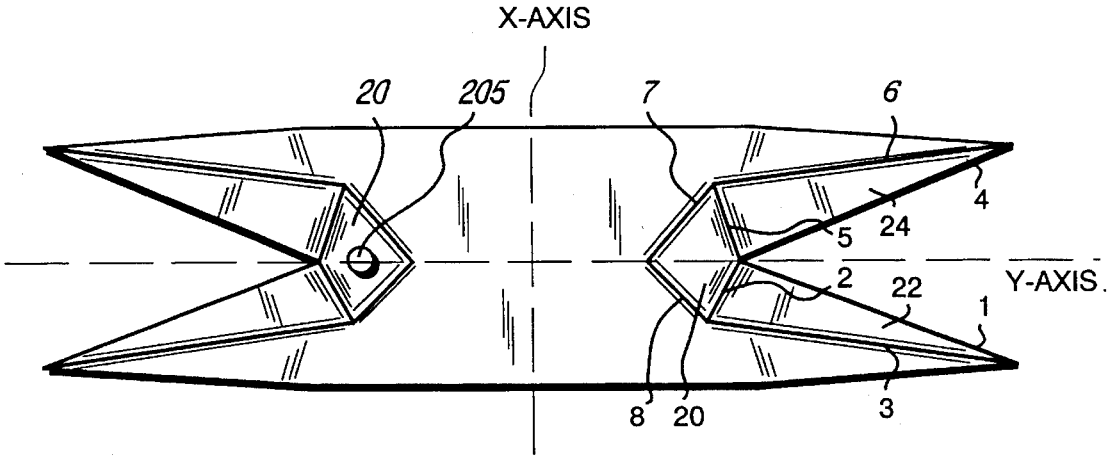
FIG. 6*a*, 6*b* are top and side views of the triangular boat hull design to illustrate the position of a single mast configuration.
Figure 6A:
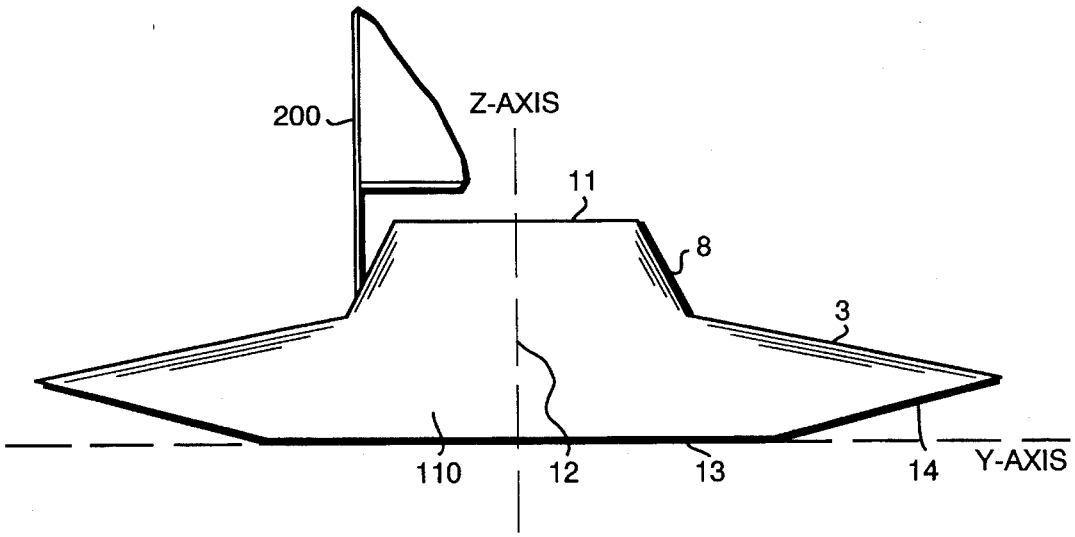
Figure 6D:
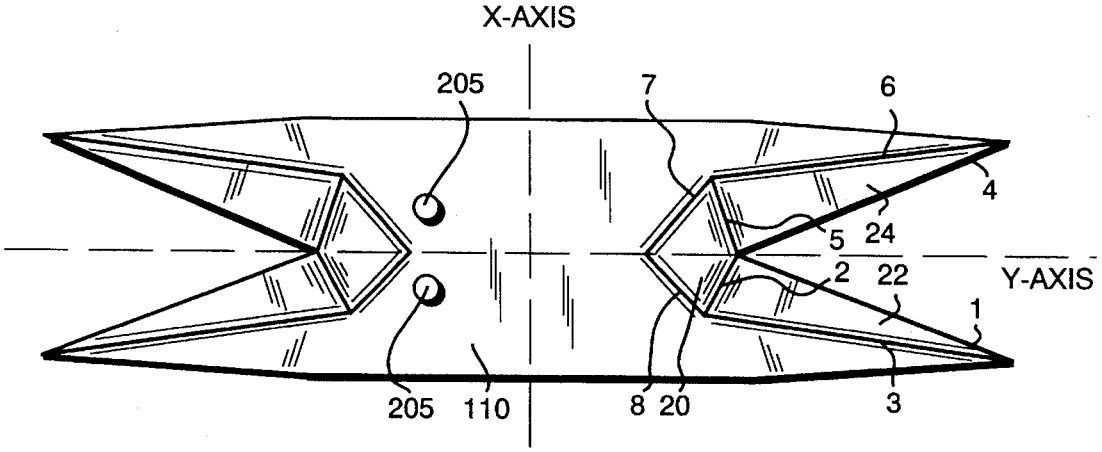
FIG. 6*c*, 6*d* are top and side views of the triangular boat hull design to illustrate the position of a double mast configuration.
Figure 6C:
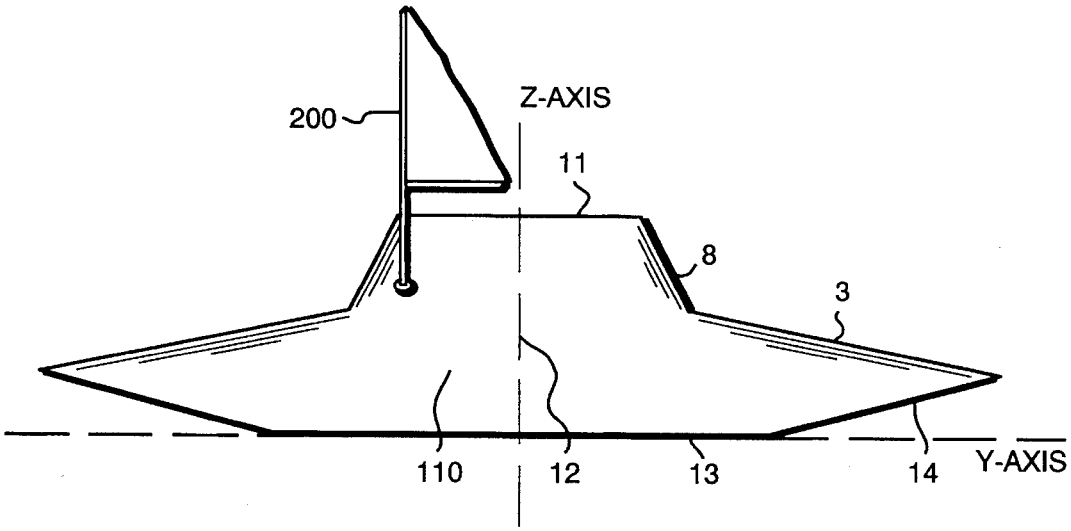

The proper placement and attachment of a mast for triangular boat hull apparatus 10 to function as a sailboat is well known in the art. FIG. 6*a* is a top and side view of triangular boat hull apparatus 10 illustrating the position of a single mast 200 through hole 205 of flat panel 20. Other positions of mast 200 would be acceptable. FIG. 6*b* is also a top and side view of triangular boat hull apparatus 10 illustrating the position of a double mast 200 through holes 205 of side panels 110. Other positions of masts 200 would be acceptable.

Figure 7B:
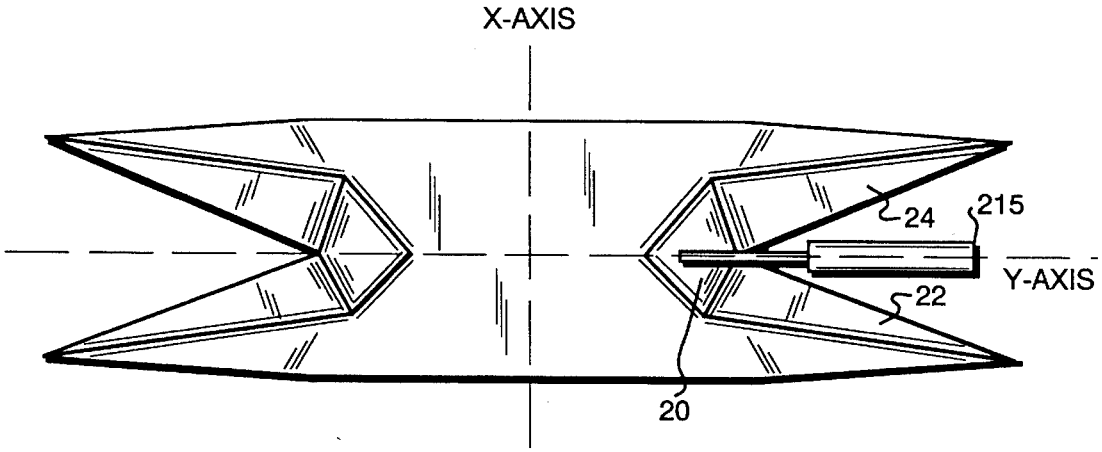
FIG. 7*a*, 7*b* are top and side views of the triangular boat hull design illustrating the position of a single rudder configuration.
Figure 7A:
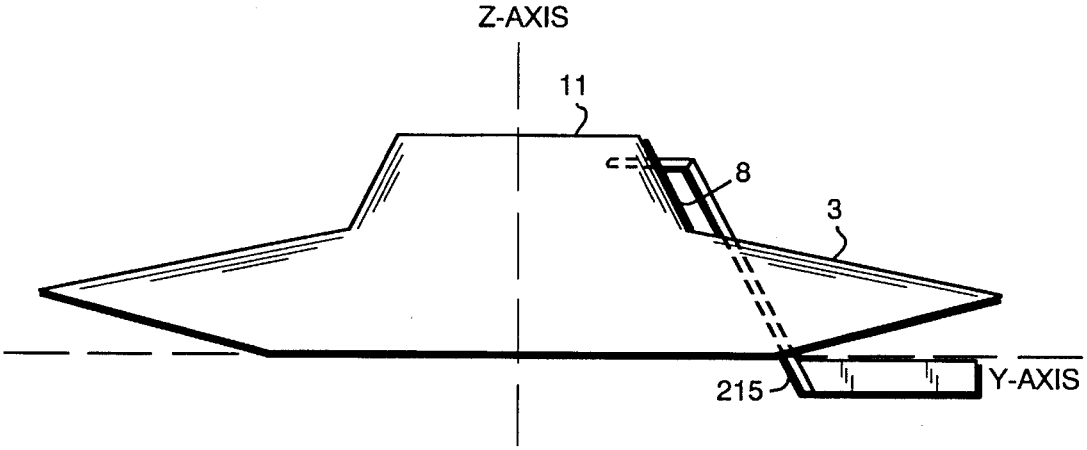
Figure 7D:
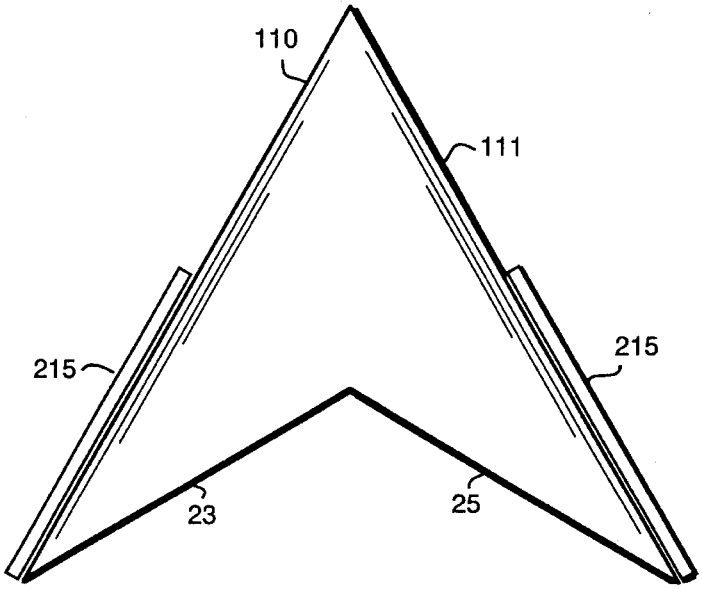
FIG. 7*c*, 7*d* are top and side views of the triangular boat hull design illustrating the position of double rudder configuration.
Figure 7C:
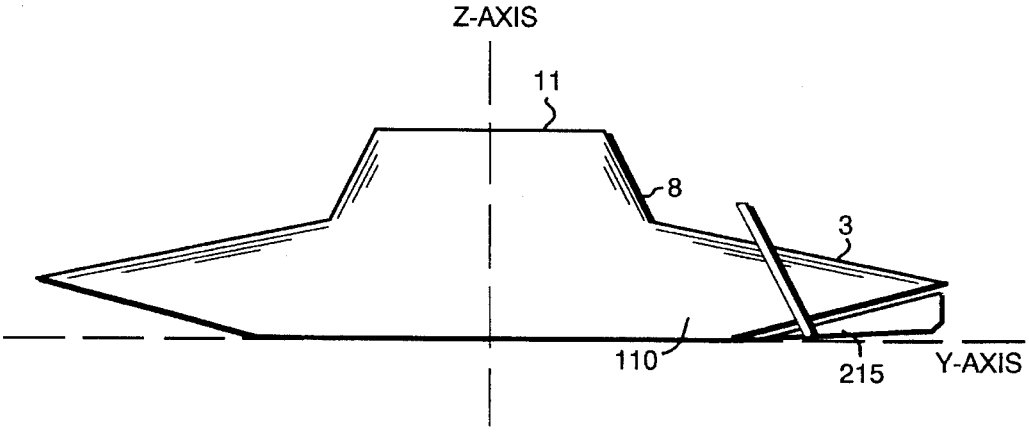

Smaller size boats, such as the one depicted in this invention, require only a single rudder. FIG. 7*a* provides a top and side view of the triangular boat hull apparatus 10 illustrating the position of single rudder 215 between flat panels 23 and 25. Larger size boats may require two rudders. For those situations, FIG. 7*b* provides a front and side view of triangular boat hull apparatus 10 illustrating rudders 215 mounted outside of flat panels 110.

Propulsion for hull apparatus 10 would also be compatible with any of the other means commonly used in the industry, such as oars, water jet, propeller driven and hydrofoil. Surface effect propulsion is possible with the addition of skirts.

Figure 8:
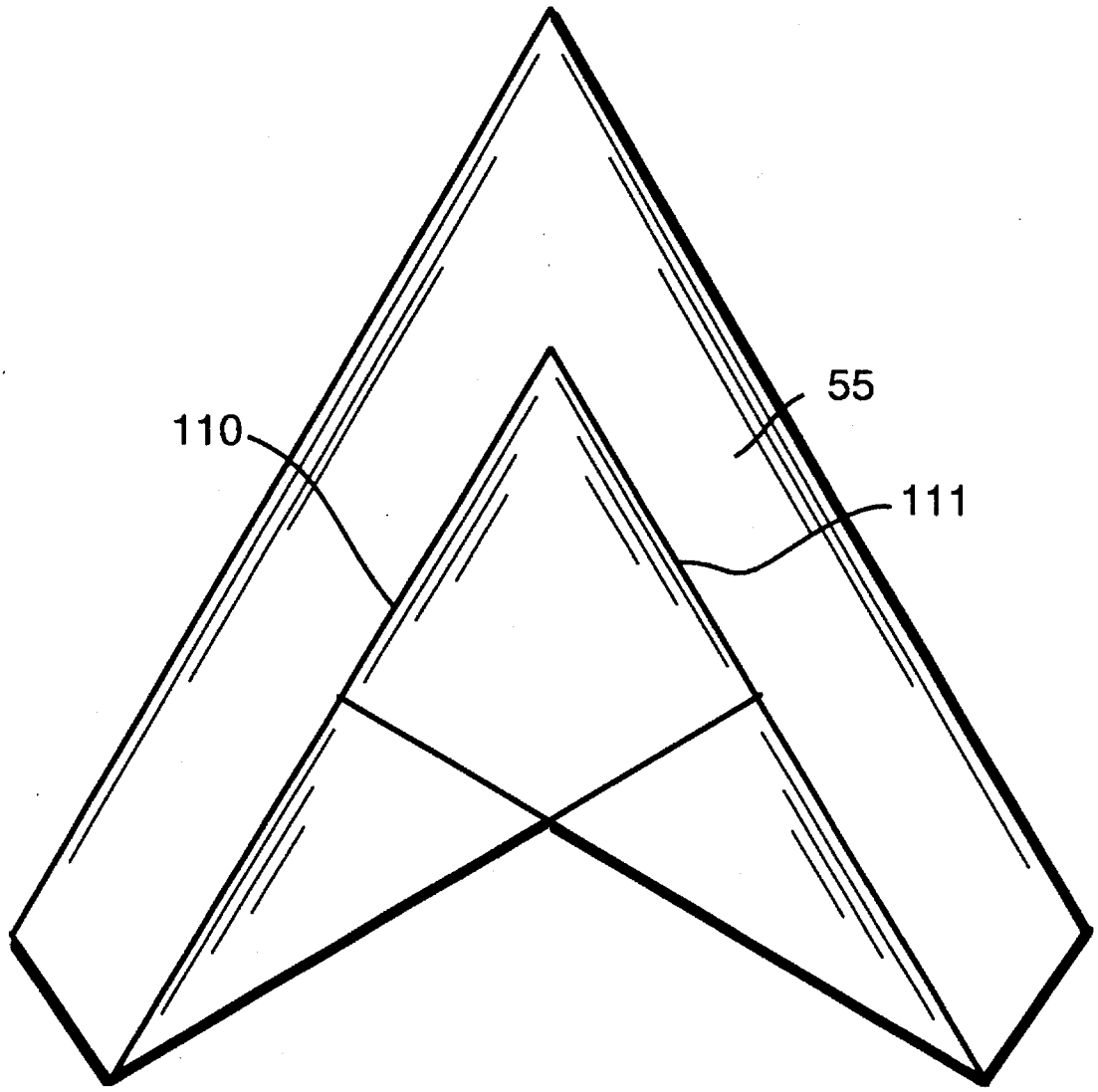
FIG. 8 is a cross-sectional view of an optional cover attached to the triangular boat hull apparatus.

FIG. 8 is a cross-sectional view of triangular boat hull apparatus 10 with an optional secondary cover 55 attached to side panels 110 and 111. Secondary cover 55 is in effect a second hull that is installed parallel to the basic hull. Utilization of secondary cover 55 provides protection from the temperature extremes while also providing extra storage for machinery, water and fuel. All stores and machinery would be below the center line to maintain the self-righting characteristics of this invention. In large boats, the area above the centerline within secondary cover 55 could serve as berths and cabins for crew and passengers. For military operations, secondary cover 55 could be constructed out of armor platting material or some other suitable material in order to provide protection from missile attacks.

Figure 8A:
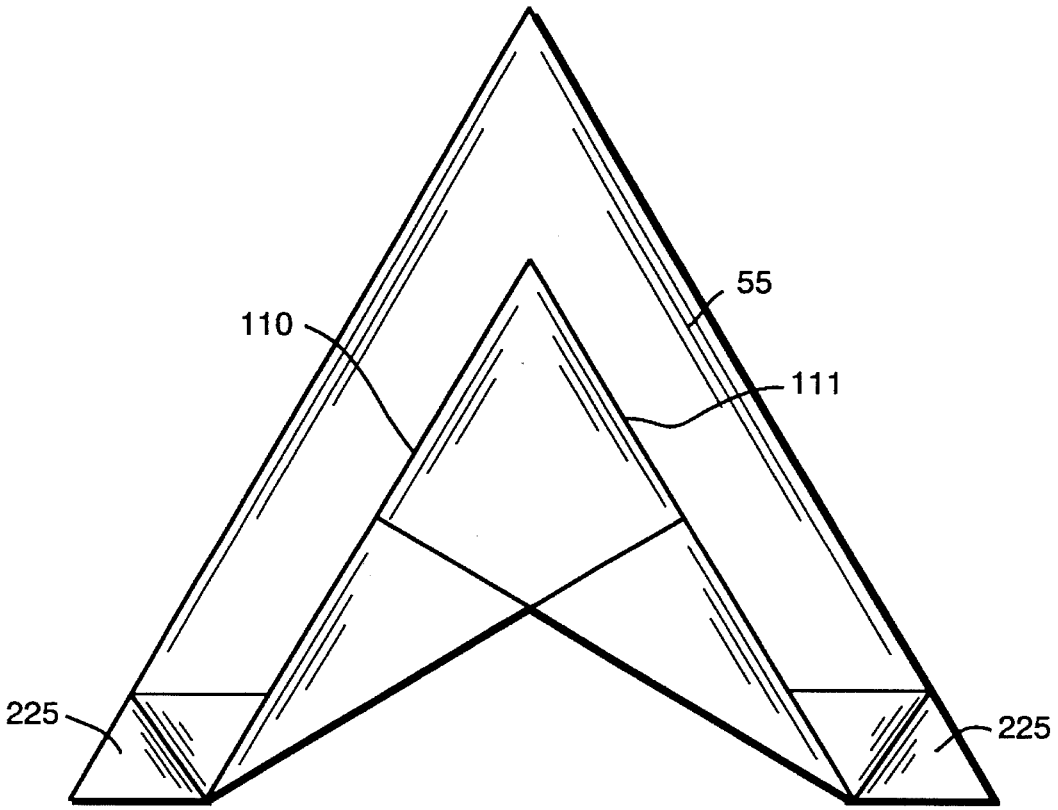
FIG. 8*a* is a cross-sectional view of an optional cover attached to the triangular boat hull apparatus that has been configured to assist in the hydro-planning features of the invention.
Figure 8B:
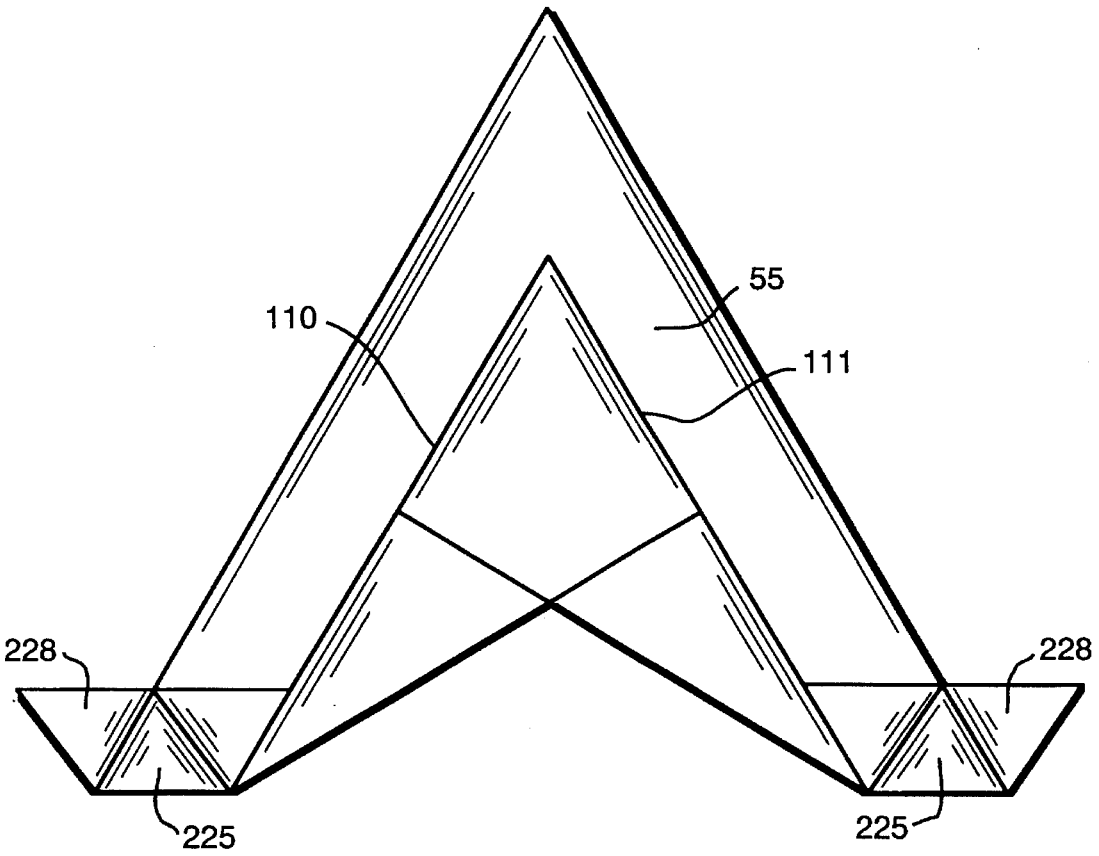
FIG. 8*b* is a cross-sectional view of an optional cover utilizing hydro-planning features of the invention with the addition of ballast tanks.
Figure 8C:
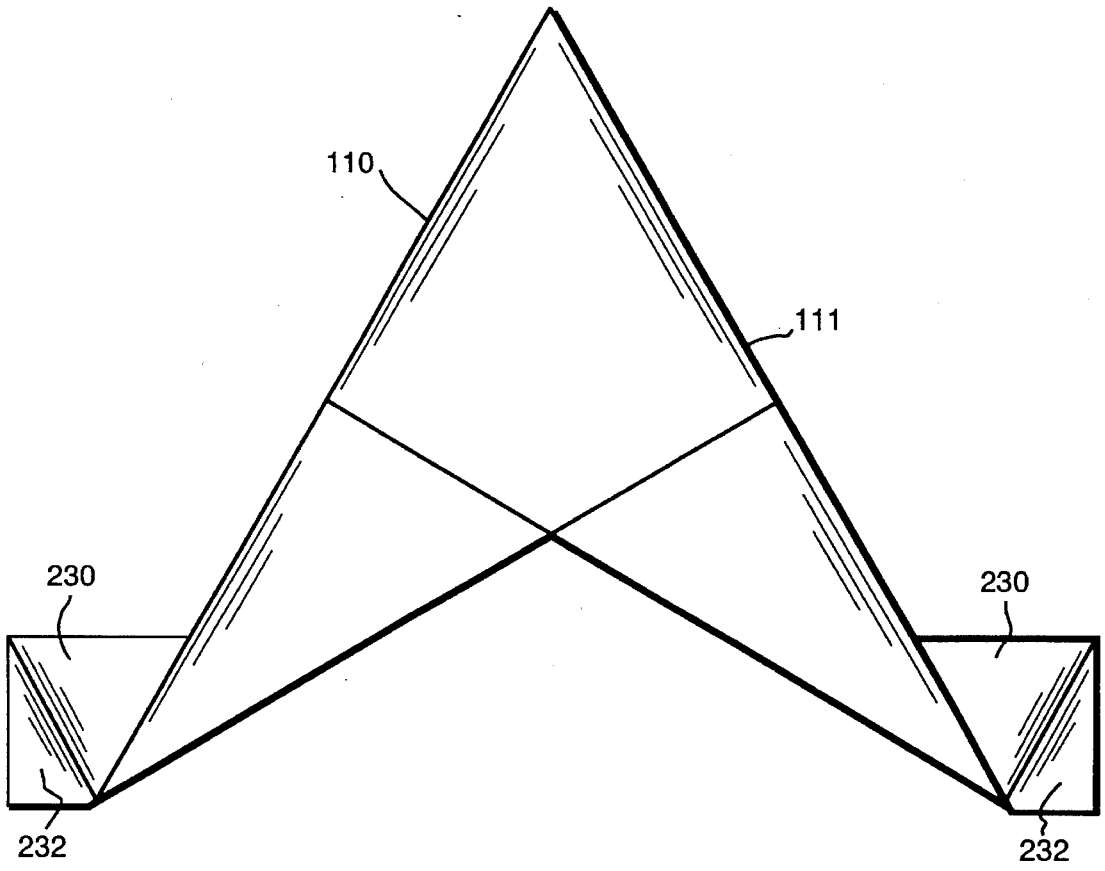
FIG. 8*c* is a cross-sectional view of the triangular boat hull design with the inclusion of a step also utilizing hydro-planning features of the invention.

FIG. 8*a* is a cross-sectional view of optional secondary cover 55 attached to triangular boat hull apparatus that has been configured to assist in the hydro-planning features of the invention. Cover 55 has been extended to include area 225 which in turn provides the desired hydro-planning features when triangular boat hull apparatus 10 is traveling across the water's surface. Cover 55 can be modified as shown in FIG. 8*b* to include ballast tanks 228. Ballast tanks 228 provide additional buoyancy to triangular boat hull apparatus 10 when cover 55 has been added. FIG. 8*c* is a cross-sectional view of triangular boat hull apparatus 10 with the inclusion of step 230 that also utilizes hydro-planning features of the invention via the addition of section 232. Step 230 and section 232 are added to the triangular boat hull design without secondary cover 55.

Figure 9:
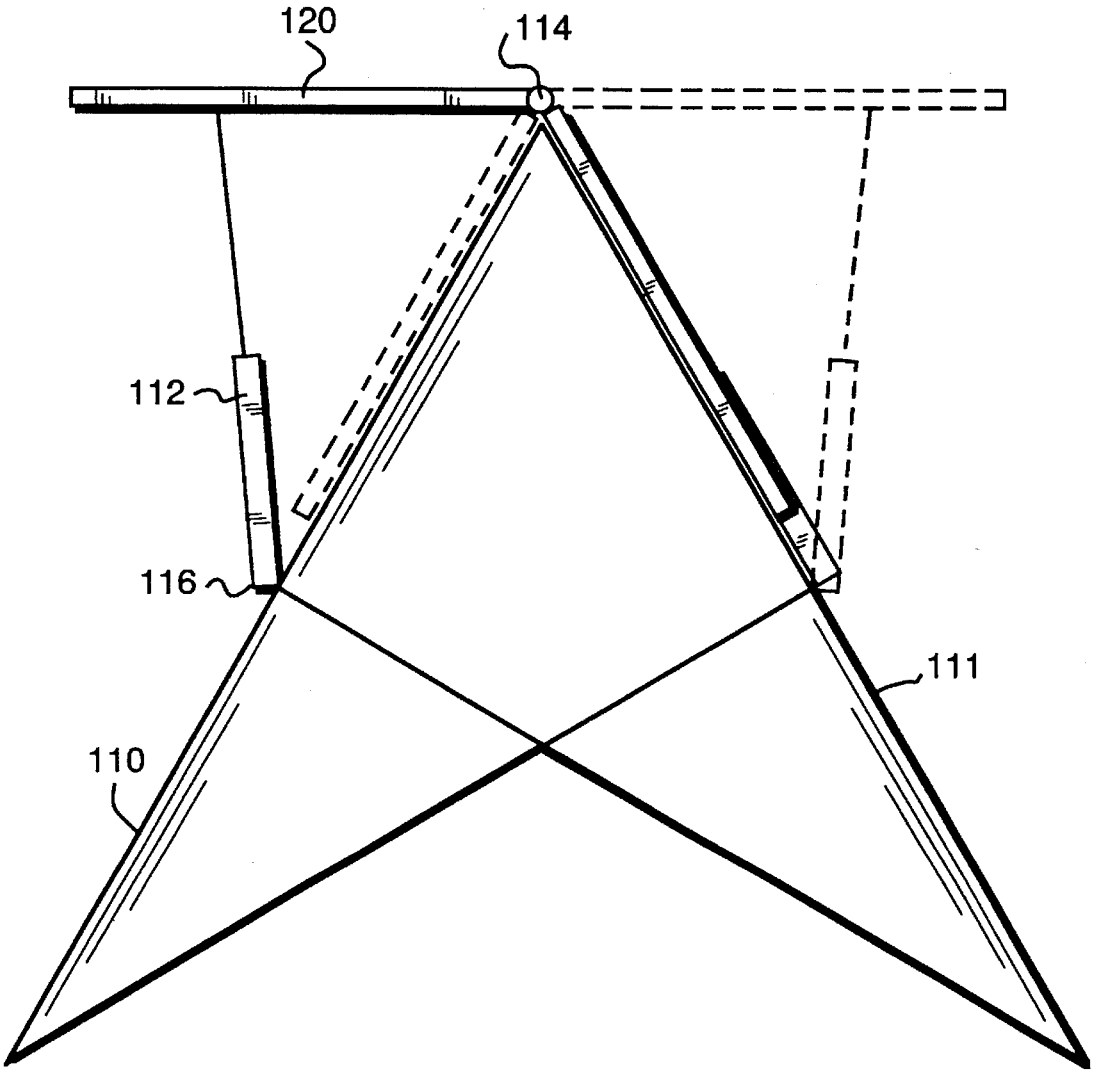
FIG. 9 is a cross-sectional view of an optional hinged platform attached to the triangular boat hull apparatus.

FIG. 9 is a side view of triangular boat hull apparatus 10 with an optional hinged platform 110 attached over side panels 110 and 111. A plurality of hydraulic cylinders 112 or some other similar type devices are used to raise and lower platform 120. Platform 120 pivots about hinge 114. When hydraulic cylinders 112 are fulled extended, platform 120 could function as a landing deck for a helicopter, provided triangular boat hull apparatus 10 is of a size sufficient to handle the weight and dimensions of a helicopter. Hydraulic cylinders 112 are securely attached to the side of triangular boat hull apparatus 10 in such a way that they will also pivot about hinge 116 when platform 120 is to be lowered. When platform 120 is in the lowered position, additional protection is provided from a missile attack, as well as providing shade from the heat of the sun.

Figure 10:
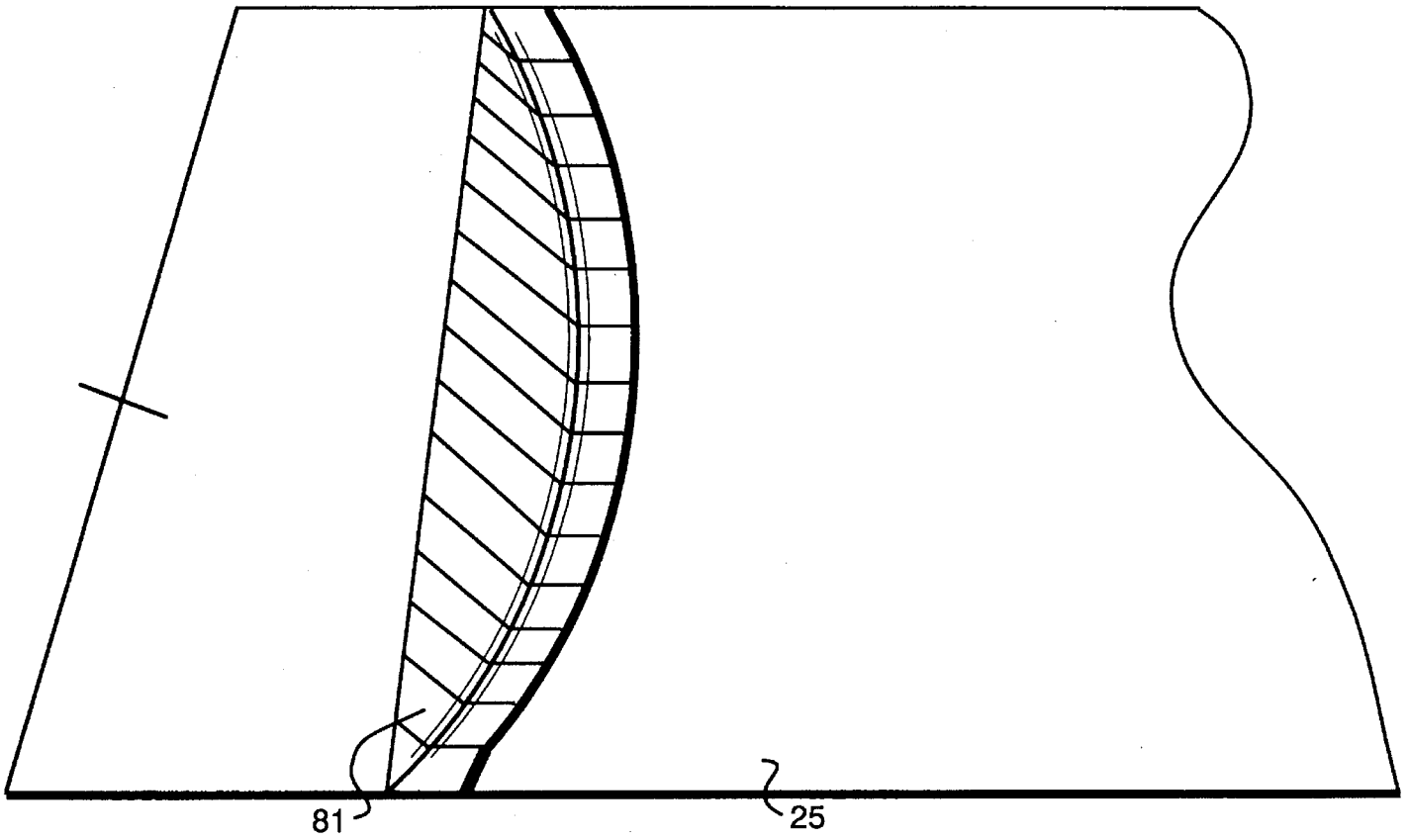
FIG. 10 is an isometric view of a flat surface of the triangular boat hull apparatus with a representation of a hydrodynamic efficient attachment affixed to the hull's surface.

FIG. 10 is an isometric view of a portion of flat surface 25 that is positioned on the underside of triangular boat hull apparatus 10 with a representation of a hydrodynamic efficient attachment 81 affixed to the surface. Wood blocks or some other type of material could be attached to the flat surfaces that are exposed to the water and sculptured to provide any desired hydraulic profile, so as to facilitate the movement of hull 10 through the water. Thus, the use of flat plate construction surfaces does not obstruct the use of hydrodynamic efficient hull forms.

Figure 11:
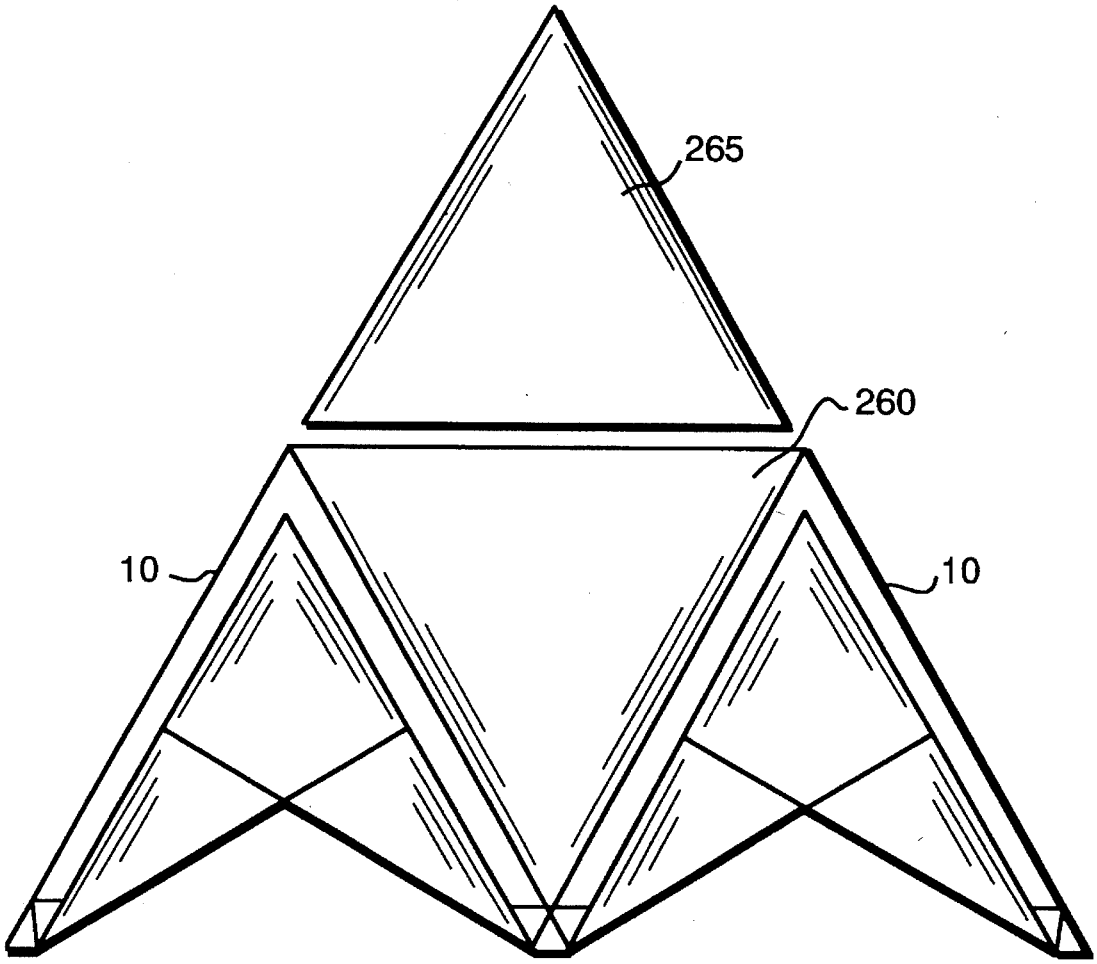
FIG. 11 is a cross-sectional view of a trimaran arrangement using the triangular boat hull concept.

FIG. 11 is a cross-sectional view of a trimaran arrangement using the triangular boat hull concept. Two triangular boat hull apparatuses 10 are attached together to provide greater stability and to support a greater payload. Section 260 can be utilized for storage and passenger space. An optional deck is available with the addition of section 265. The advantage of this design is to provide a reduced drag. Because of the reduced drag, passengers can be transported faster and more economically. The shallow draft allows the vessel to beach, reducing the need for extensive dock facilities. The low wake profile also allows the vessel to operate at high speed in restricted areas without causing wake damage to the shore, facilities or other craft.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A multi-hull apparatus having a direction of travel comprising:

a starboard hull section having a bow wave penetrating section, a stern wave penetrating section, a center section;

a port hull section having a bow wave penetrating section, a stern wave penetrating section, a center section, with said starboard bow wave and stern wave penetrating sections being substantially equal to one another, and with said port bow wave and stern wave penetrating sections being substantially equal to one another and substantially mirror images of said starboard bow wave and stern wave penetrating sections, and said starboard center section being joined together with said port center section to form a triangular center hull section and wherein each of said sections further comprises a plurality of intersecting flat surfaces.

2. The multi-hull apparatus of claim 1 wherein each of said wave penetrating sections further comprises:

a triangular first, second and third panels, said panels joined together such that said panels meet in a common vertex that is oriented to the direction of travel of said multi-hull apparatus.

3. The multi-hull apparatus of claim 2 wherein said triangular center hull section further comprises:

a starboard side panel having a top edge and bottom edge, a port side panel having a top edge and a bottom edge, wherein said starboard and said port side panels are joined together at said top edges to form a midline of said apparatus;

a port bottom panel having an outside edge and an inside edge, a starboard bottom panel having an outside edge and an inside edge, wherein said bottom panels are joined together at said inside edges to form a V-shaped bottom, and the outside edges of said bottom panels are joined with the respective bottom edges of said side panels.

4. The multi-hull apparatus of claim 3 wherein said apparatus has a wetted area, said apparatus further comprising:

a plurality of hydrodynamically-shaped attachment members, each of said members having a flat surface and a curved surface, with said flat surface of said members at least partially affixed to the wetted area of said apparatus, said attachments adapted and dimensioned to facilitate movement of said hull through the water.

5. The multi-hull apparatus of claim 3 further comprising a single mast connected to said triangular center hull section on the midline.

6. The multi-hull apparatus of claim 3 further comprising a double mast connected to said triangular center hull section, each of said masts being equidistant from the midline of said apparatus.

7. The multi-hull apparatus of claim 3 further comprising a plurality of structural ribs within said triangular center hull section.

8. The multi-hull apparatus of claim 7 wherein each of said structural ribs further comprises two right triangles.

9. The multi-hull apparatus of claim 3 wherein said triangular center hull section further comprises sufficient ballast below the centerline of said apparatus such that if said apparatus is turned bottom-side up, said apparatus will return to bottom-side down by itself.

* * * * *